US006582264B2

(12) United States Patent
Brown

(10) Patent No.: US 6,582,264 B2
(45) Date of Patent: Jun. 24, 2003

(54) PORTABLE, MULTI-USE WATER DEVICE

(75) Inventor: Paul Lee Brown, Auburn, CA (US)

(73) Assignee: Aqua Sports Technology, Inc., Auburn, CA (US)

( * ) Notice: Subject to any disclaimer, the term of this patent is extended or adjusted under 35 U.S.C. 154(b) by 0 days.

(21) Appl. No.: 09/971,814

(22) Filed: Oct. 5, 2001

(65) Prior Publication Data

US 2003/0068937 A1 Apr. 10, 2003

(51) Int. Cl.[7] ..... B63B 35/58
(52) U.S. Cl. ..... 441/40; 114/61.1; 114/354
(58) Field of Search ..... 441/45, 65, 129, 441/130; 114/61.1, 61.23, 354; 482/27; 428/102, 120, 138

(56) References Cited

U.S. PATENT DOCUMENTS

| | | | | | |
|---|---|---|---|---|---|
| 522,348 | A | * | 7/1894 | Martini | 114/61.1 |
| 2,745,118 | A | * | 5/1956 | Potts et al. | 114/61.1 |
| 3,047,294 | A | * | 7/1962 | Maxwell | 482/27 |
| 3,846,858 | A | * | 11/1974 | Syfritt | 114/354 |
| 4,082,049 | A | * | 4/1978 | Nicol | 114/354 |
| 4,315,475 | A | * | 2/1982 | Echols | 441/130 |
| 4,361,614 | A | * | 11/1982 | Moffitt, Jr. | 428/138 |
| 4,715,306 | A | * | 12/1987 | Horais | 114/354 |
| 4,823,717 | A | * | 4/1989 | Roberson | 114/61.1 |
| 4,829,627 | A | * | 5/1989 | Altus et al. | 428/99 |
| 4,854,257 | A | * | 8/1989 | Grayson | 114/61.23 |
| 4,998,498 | A | * | 3/1991 | Gallichan | 114/354 |
| 5,013,270 | A | * | 5/1991 | Walls | 114/61.1 |
| 5,290,196 | A | * | 3/1994 | Steel | 441/130 |
| 5,368,511 | A | | 11/1994 | James | |
| 5,385,518 | A | * | 1/1995 | Turner | 482/27 |
| 5,413,066 | A | * | 5/1995 | Spencer, et al. | 114/354 |
| 5,522,741 | A | * | 6/1996 | Yun | 114/354 |
| 5,630,371 | A | * | 5/1997 | Morrelli et al. | 114/61.23 |
| 5,878,688 | A | * | 3/1999 | Merrett et al. | 114/354 |
| 6,024,041 | A | * | 2/2000 | Eglais | 114/61.1 |
| 6,311,632 | B1 | * | 11/2001 | Noel, Jr. | 114/61.1 |
| 6,352,757 | B1 | * | 3/2002 | Kessler et al. | 428/120 |
| 6,455,123 | B1 | * | 9/2002 | Poe, Sr. | 428/102 |

OTHER PUBLICATIONS

Delphion patent search results dated Sep. 21, 2001, 2 pgs.

* cited by examiner

*Primary Examiner*—S. Joseph Morano
*Assistant Examiner*—Lars A. Olson
(74) *Attorney, Agent, or Firm*—Gerald E. Helget; Nelson R. Capes; Briggs and Morgan

(57) ABSTRACT

A steel frame assembly that attaches to a 5-chamber, side-by-side inflatable water sled. The frame assembly supports a surface area that consists of a cargo mat and a polypropylene trampoline mat with protective pads. The water sled is slightly modified and structurally reinforced to allow a frame to be attached. The frame assembly converts the water sled into a portable, multi-use product that can be towed behind a boat.

17 Claims, 3 Drawing Sheets

PORTABLE, MULTI-USE WATER DEVICE

BACKGROUND OF THE INVENTION

The present invention relates to a collapsible, portable, multi-use, inflatable device that can be used as a water sled, a water trailer, a floating platform (or raft) or a water trampoline.

Personal watercraft are now very popular. However, such personal watercraft have very limited or no space for storing cargo. Consequently, if a user wishes to transport cargo using such a watercraft, it is necessary to make multiple trips.

Water sleds have been used in the past as recreational vehicles for towing behind a boat. However, such water sleds have typically had no cargo transporting capability, but rather have been used solely as a recreational vehicle for carrying people and are comprised of inflatable tubes.

A water sled that can be used to transport cargo is disclosed in U.S. Pat. No. 5,368,511. However, the device is not usable as a swim platform or trampoline because the support frame is not enclosed, and users may be hurt if they come into contact with the support frame.

Water trampolines are known, in which a floating structure has a deformable mat that can be used as a trampoline.

There is a need for a single, portable, multi-use inflatable device that can be used as a water sled, a water trailer, a floating water platform or as a water trampoline.

SUMMARY OF THE INVENTION

A steel frame assembly that attaches to a 5-chamber, side-by-side inflatable water sled. The frame assembly supports a surface area that consists of a cargo mat and a polypropylene trampoline mat with protective pads. The water sled is slightly modified and structurally reinforced to allow a frame to be attached. The frame assembly converts the water sled into a portable, multi-use product that can be towed behind a boat.

A principle object and advantage of the present invention is that it converts a water sled into a water trailer that can be pulled behind a personal watercraft or any watercraft with sufficient pulling power.

Another principle object and advantage of the present invention is that the water trailer allows the owner to carry cargo easily on the top of the cargo mat and allows the owner to tie off and secure the cargo to tie-down grommets provided on the mat.

Another principle object and advantage of the present invention is that the water sled converts to a swim platform, or trampoline including attachable safety pads that protect the user from hitting the steel frame.

Another principle object and advantage of the present invention is that it includes D-rings that allow the invention to be anchored to the bottom of a lake, creating a stable swim deck or water platform.

Another principle object and advantage of the present invention is that the water platform can be used as a swimmers assist platform, a hunting platform, a portable water ski take-off platform or for any activity where a floating platform is needed.

Another principle object and advantage of the present invention is that it can be used as a sun deck and is collapsible for storage or transportation.

DETAILED DESCRIPTION OF THE PREFERRED EMBODIMENT

Figure 1:
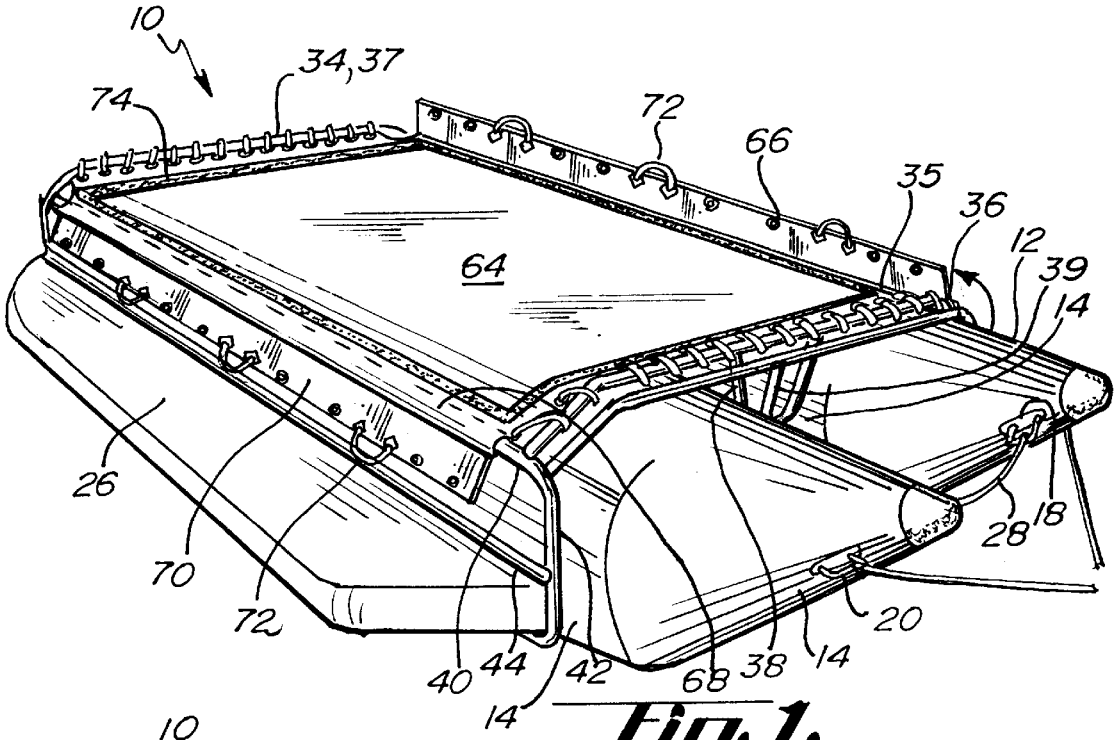
FIG. 1 is a side perspective view of the device as a water trailer.

The collapsible, multi-use water device is generally designated by numeral 10 and may be viewed in FIGS. 1–6. The device 10 generally comprises a multi-chambered inflatable water sled 12, a stainless steel frame 34 capturing the water sled 12, cargo mat 64 and a padded mat 78.

The details of the water sled 12 may be appreciated by viewing FIGS. 1–4 and 6. The sled 12 has inflatable large tubes 14 with coned ends 16, inner opposing support rings 18, and outer anchor rings 18 are on the forward cone ends 16 of tubes 14. In between the inflatable large tubes 14 is intermediate buoyancy tube 22, also having coned ends 24. Lateral stabilizing wings 26 extend outwardly from the large tubes 14. The lateral stabilizing rope 28 connects the inner support rings 18 located frontwardly and rearwardly on the large tubes 14 to further capture intermediate buoyancy tube 28 and to prevent the inflatable large tubes 14 from separating away from each other in a downwardly and outwardly fashion. The tow or anchor rope 30 is secured to the outer anchor rings 20 and may be used to anchor the device 10 to the bottom of the lake or otherwise tow the device 10 with a self-propelled watercraft.

The details of the stainless steel tubular frame 34 may be greatly appreciated by viewing all of the FIGS. 1–6. Steel frame 34 is suitably U-shaped when viewing from a front or rear view and is longitudinally linear front to back while retaining strength to permit the water device 10 to move through the water with minimal resistance. Steel frame 34 includes rigidifying top cross beams 35, 36 and 37 with an optional fourth cross beam 37 shown in phantom in FIG. 2. Cross beams 35 and 37 have intermediate depending tube buoyancy supports 38, which rest upon intermediate buoyancy tube 22. Stabilizing strut 39 extends from outermost top cross beams 35 and 37 to supports 38 to add strength to the overall frame 34. Top longitudinal beams 40 are connected to the cross beams 35, 36 and 37 suitably by welding.

From the top longitudinal beams 40 are depending and opposing rectangular subframes 48 which capture the large tubes 14. The subframes 42 include intermediate longitudinal members 44 and bottom longitudinal members 46. The intermediate and bottom members 44 and 46 capture the lateral stabilizing wings 26 of the water sled 12 when the water sled is inflated with the steel frame 34 therearound.

Figure 2:
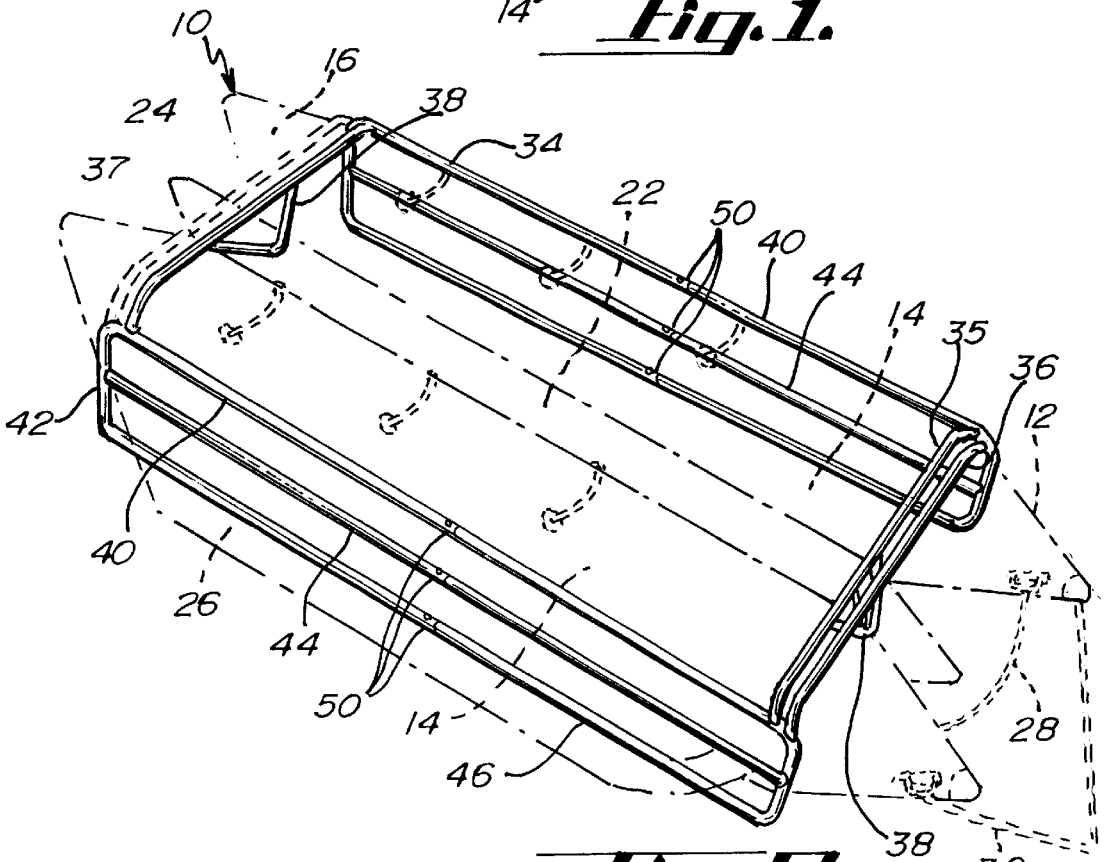
FIG. 2 is a top perspective view of the frame on top of the water sled shown in phantom outline.
Figure 3:
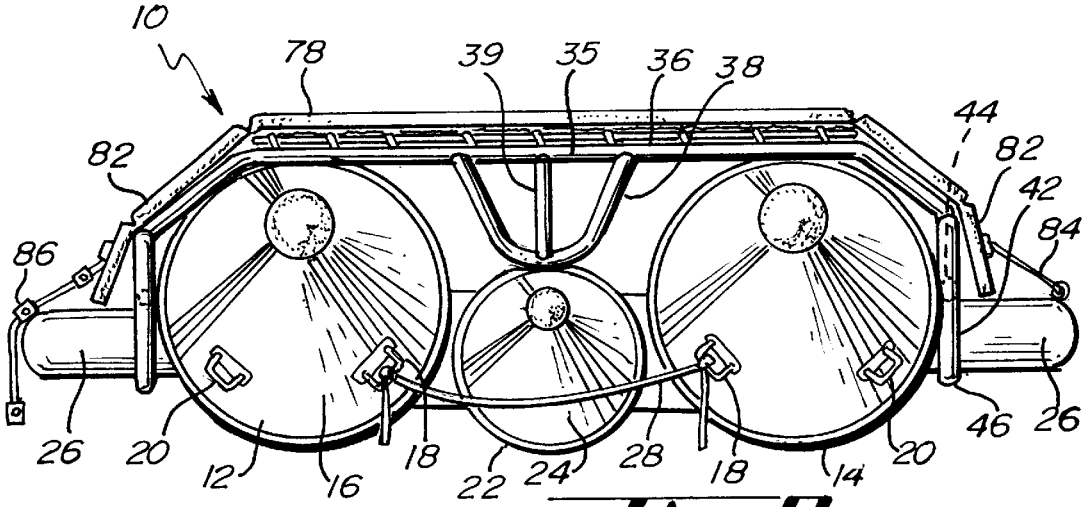
FIG. 3 is a front elevational view of the device converted to a swim platform or trampoline.
Figure 4:
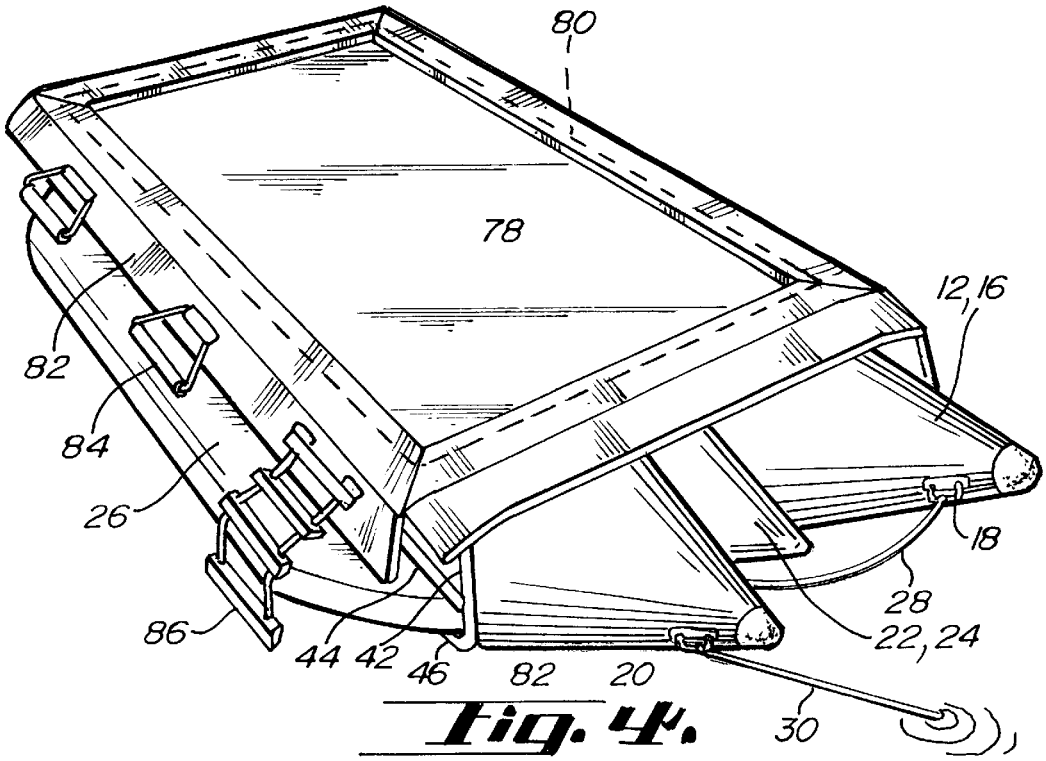
FIG. 4 is similar to FIG. 1, with the trampoline mat added to further enclose the frame with the addition of a swim ladder, the device being anchored.
Figure 5:
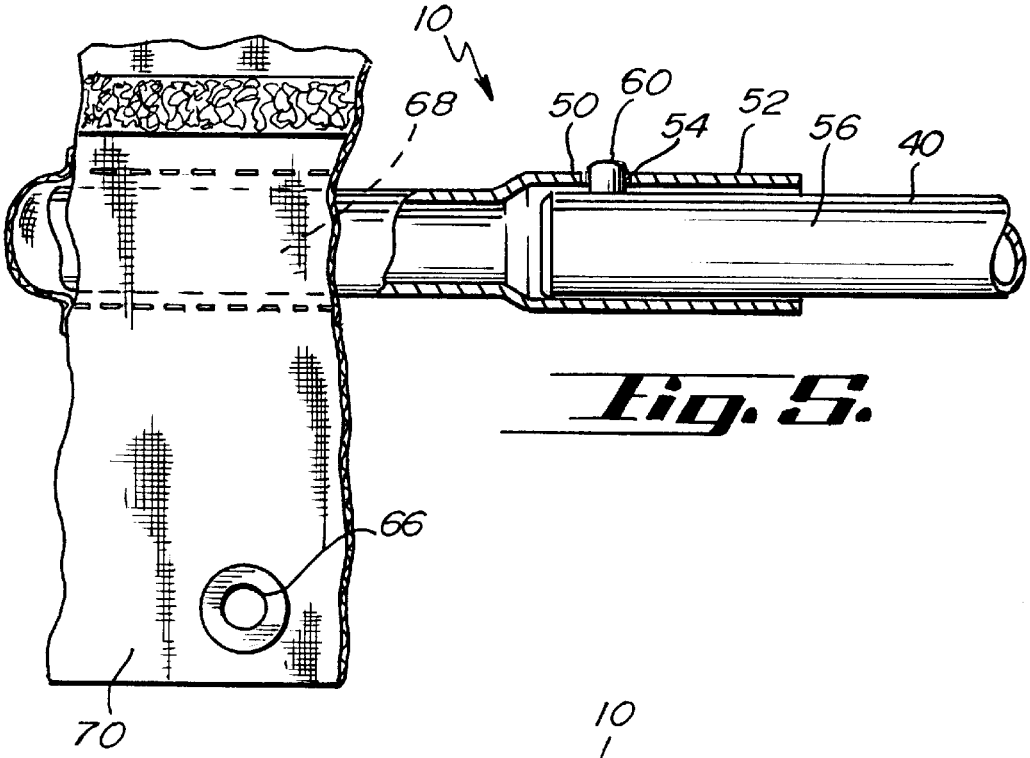
FIG. 5 is a broken and cut away view of the frame showing the disassembly mechanism.

While it is known that the water sled 12 may be deflated and folded or rolled up for transportation, the steel frame 34 has frame joints 50 shown in FIGS. 2 and 5. The joints 50 are positioned intermediately in the top longitudinal beams 40, intermediate longitudinal members 44 and bottom longitudinal members 46. The frame joints 50 each have an elongate sleeve 52 with an aperture 54 therein. The sleeve 52 captures the opposing frame end 56 sufficiently to assure rigidity of the overall frame, while a spring-loaded securing button 60 locks into aperture 54 of sleeve 52. Thus, steel frame structure 34 comprised of tubes, may be broken in half for easy transportation or storage.

The cargo mat 64 of the water device 10 may best be viewed in FIGS. 1, 3, 5 and 6. The cargo mat 64 has peripheral grommets 66 and two opposing longitudinal sleeves 68 which capture the top longitudinal beams 40 clearly shown in FIGS. 1, 5 and 6. Cargo flaps 70 extend laterally from the cargo mat 64 and suitably support gripping handles 72 as well as the previously disclosed grommet 66. Inwardly and adjacent to the steel frame 34 on top of the cargo mat 64 is a rectangular hook and loop strip as will be appreciated later.

Figure 6:
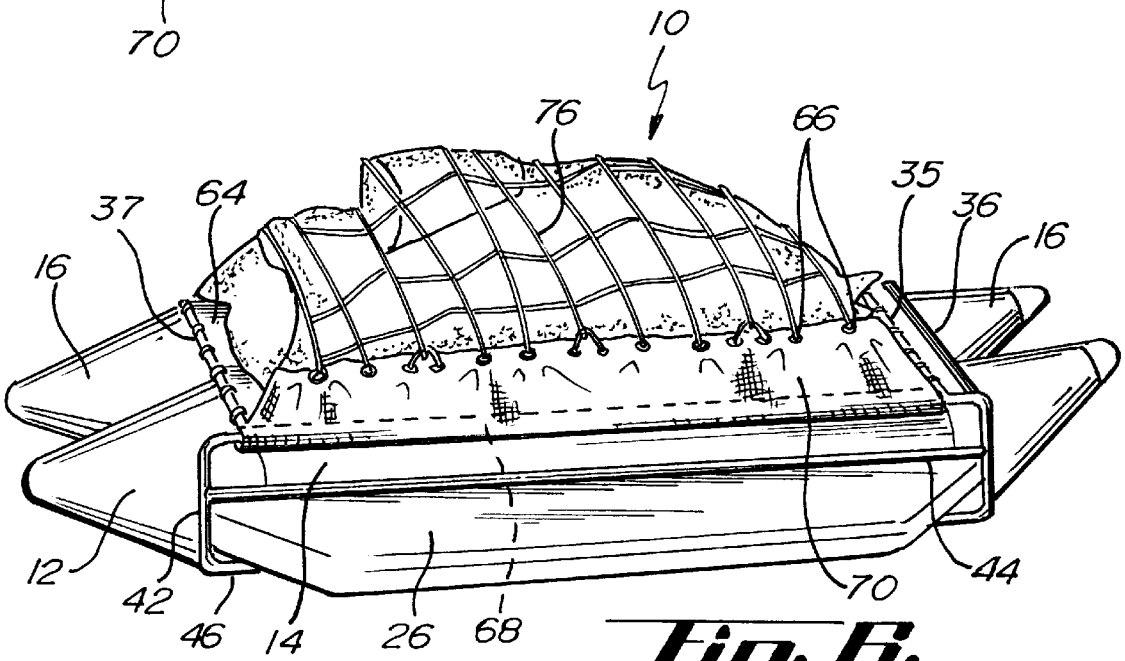
FIG. 6 is a perspective view of the device used as a cargo trailer.

The cargo flaps 70 may be lifted upwardly onto the mat 64 to further enclose cargo and to permit the cargo net or rope 76 to be interwoven with grommet 66, as clearly depicted in FIG. 6.

The padded mat 78 permits the device 10 to be used as a sun deck, swim platform or trampoline. The underside of padded mat 78 has cooperating rectangular hook and loop strips 80 to match with the rectangular hook and loop strip 74 on the cargo mat 64 to secure the padded mat 78 to the cargo mat 64. The padded mat 78 has extending frame pads 82 peripherally located therearound to cover all of the steel frame 34. Handles 84 and ladder 86 may also be secured to the padded mat 78, as is conventionally known.

In use, the water device 10 may be used simply as a water sled 12 upon which people may sit and hold onto the handles shown in FIG. 2 (unnumbered) in phantom outline. Alternatively, the water sled 12 may be somewhat or completely deflated and the steel frame 34 placed thereover. Upon inflation of the sled 12, the lateral stabilizing wings 26 pass through and in between intermediate and bottom longitudinal members 44 and 46 to capture the water sled 12 underneath the frame 34. The depending intermediate two buoyancy supports 38 further secured by strut 39 rest upon intermediate buoyancy tube 22 to give the water device further support from below and when the device 10 is used as a trampoline.

As may be appreciated, cargo may be loaded on top of the water device 10 and secured, as shown in FIG. 6, to be towed by a self-propelled watercraft. The padded mat 78 may be laid upon the cargo mat 64 and held securely by the hook and loop strips 74 and 80 with the extending frame pads 82 extending over the steel frame 34. Padded mat 78 may also be secured to frame 34. In this condition, the water device 10 may be used as a sun deck, swim platform or trampoline by young children. Handles 84 and ladder 86 may be attached to padded mat 78 to make the water device 10 more user friendly.

What is claimed:

1. A collapsible, portable multi-use water device, comprising:

(a) two inflatable large tubes align ed together;

(b) a U-shaped rectangular frame adapted to be inverted to capture the large tubes, the frame having a rectangular top;

(c) a flexible mat adapted to be secured to the top of the frame; and (d) outwardly extending lateral stabilizing wings captured by depending rectangular subframes, the subframes being disconnected from one another.

2. The device of claim 1, further comprising a small intermediate buoyancy tube between the two large tubes.

3. The device of claim 2, wherein the frame has depending supports resting on the intermediate tube.

4. The device of claim 1, wherein the frame disassembles into two pieces.

5. The device of claim 1, wherein the tubes have conical ends.

6. The device of claim 1, wherein the tubes are tied together.

7. The device of claim 1, further comprising cargo flaps on the mat.

8. The device of claim 1, further comprising a second padded mat securable onto the first mat with padded flaps covering the frame.

9. A collapsible, portable multi-use water device, comprising:

(a) two inflatable large tubes aligned together with an intermediate small inflatable tube therebetween;

(b) a U-shaped rectangular frame adapted to be inverted to capture the large tubes, the frame having a rectangular top, wherein the frame has depending supports resting on the intermediate tube;

(c) a first flexible mat adapted to be secured to the top of the frame; and (d) a second padded mat securable onto the first mat with padded flaps covering the frame.

10. The device of claim 9, further comprising cargo flaps on the first mat.

11. The device of claim 9, wherein the frame disassembles into two pieces.

12. The device of claim 9, further comprising outwardly extending lateral stabilizing wings captured by depending rectangular subframes, the subframes being disconnected from one another.

13. The device of claim 9, wherein the tubes have conical ends.

14. The device of claim 9, wherein the tubes are tied together.

15. A collapsible, portable multi-use water device, comprising:

(a) two inflatable large tubes aligned together with outwardly extending lateral stabilizing wings and an inflatable intermediate small tube between the large tubes;

(b) a U-shaped rectangular tubular frame adapted to be inverted to capture the wings and large tubes, the frame having a rectangular top, wherein the frame has depending supports resting on the intermediate tube;

(c) a flexible mat adapted to be secured to the top of the frame with cargo flaps; and (d) a second padded mat securable onto the frame and first mat with padded flaps covering the frame.

16. The device of claim 15, wherein the tubes have conical ends.

17. The device of claim 15, wherein the tubes are tied together.

* * * * *